US008517375B2

(12) United States Patent
Otani et al.

(10) Patent No.: US 8,517,375 B2
(45) Date of Patent: Aug. 27, 2013

(54) FEEDING DEVICE AND RECORDING DEVICE

(75) Inventors: Tsuyoshi Otani, Chino (JP); Yoshikane Tsuchihashi, Matsumoto (JP); Kohei Usuda, Shiojiri (JP); Satoru Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/045,834

(22) Filed: Mar. 11, 2011

(65) Prior Publication Data

US 2011/0221123 A1 Sep. 15, 2011

(30) Foreign Application Priority Data

Mar. 12, 2010 (JP) ..... 2010-055464

(51) Int. Cl.
*B65H 3/52* (2006.01)
*B65H 3/34* (2006.01)

(52) U.S. Cl.
USPC ..... 271/167; 271/124; 271/121

(58) Field of Classification Search
USPC ..... 271/167, 124
See application file for complete search history.

(56) References Cited

U.S. PATENT DOCUMENTS

| | | | | |
|---|---|---|---|---|
| 5,485,991 | A * | 1/1996 | Hirano et al. | 271/121 |
| 6,502,816 | B2 * | 1/2003 | Inoue et al. | 271/121 |
| 6,880,821 | B2 * | 4/2005 | Park | 271/121 |
| 7,000,916 | B2 * | 2/2006 | Asada et al. | 271/121 |
| 7,021,621 | B2 * | 4/2006 | Asada et al. | 271/124 |
| 7,128,317 | B2 * | 10/2006 | Johnson et al. | 271/121 |
| 7,370,858 | B2 * | 5/2008 | Youn | 271/121 |
| 7,543,814 | B2 * | 6/2009 | Qi et al. | 271/167 |
| 2003/0132570 | A1 * | 7/2003 | Park | 271/167 |
| 2004/0065992 | A1 * | 4/2004 | Youn | 271/121 |
| 2004/0245703 | A1 * | 12/2004 | Yun et al. | 271/110 |
| 2005/0051945 | A1 * | 3/2005 | Kang | 271/121 |
| 2005/0082742 | A1 * | 4/2005 | Kang et al. | 271/121 |

FOREIGN PATENT DOCUMENTS

JP 2007-153530 6/2007

* cited by examiner

*Primary Examiner* — Patrick Cicchino
(74) *Attorney, Agent, or Firm* — Workman Nydegger

(57) ABSTRACT

There is provided a feeding guide unit that slides according to a width size of the feeding material in a receiving unit that receives a plurality of feeding materials, and a separation unit having an inclined surface structure that abuts on a tip of the fed feed material so that a separating load is exerted, and separates the following feed material to feed only the feed material at the uppermost position. The separating load of the separation unit is changed to at least two stages in conjunction with a movement in a width direction of the feeding guide unit.

8 Claims, 11 Drawing Sheets

FIG. 11

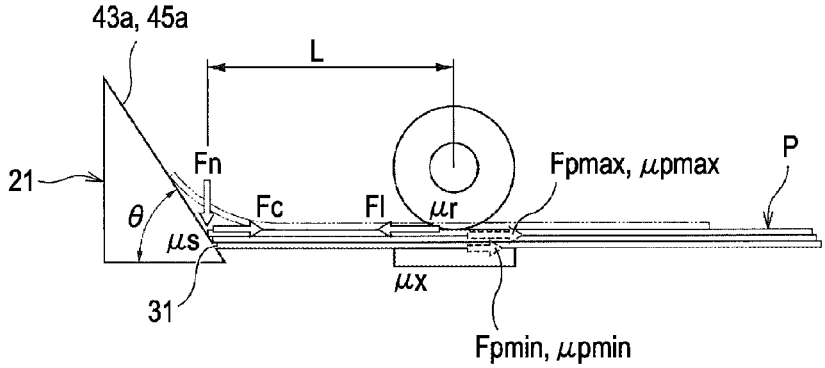

| | |
|---|---|
| MAXIMUM BENDING | $\delta max = Fn \cdot L^3/3EI = Fn \cdot L^3/3E(bh^3/12)$ |
| MAXIMUM REACTIVE FORCE | $Fn = 3EI \cdot \delta max/L^3$ |
| SECTION MODULUS | $I = bh^3/12$ |
| SEPARATING LOAD RESISTANCE | $Fc = Fn \cdot (\mu s + \tan\theta)/(1 - \mu s + \tan\theta)$<br>$= (3EI \cdot \delta max/L^3) \cdot (\mu s + \tan\theta)/(1 - \mu s + \tan\theta)$<br>$= 3E(bh^3/12)\,\delta max/L^3) \cdot (\mu s + \tan\theta)/(1 - \mu s + \tan\theta)$ |

FEEDING DEVICE AND RECORDING DEVICE

The entire disclosure of Japanese Patent Application No. 2010-055464, filed Mar. 12, 2010 is expressly incorporated by reference herein.

BACKGROUND

1. Technical Field

The present invention relates to a feeding device including a separation unit that separates one piece of the uppermost material to be fed from the following material to be fed from a plurality of stacked materials to be fed to thereby feed only one piece of the uppermost material to be fed, and has an inclined surface separation structure obtaining a separating load by abutting on a tip of the material to be fed, and a recording device including the feeding device.

2. Related Art

In a recording device such as a laser printer, an inkjet printer, or the like, there exists a printer in which a feeding cassette is mounted to be capable of performing the recording of a large number of continuous materials to be recorded (hereinafter, referred to as "paper"). As the feeding cassette mounted in the printer, a separation unit, having an inclined surface separation structure, abutting on an end face of a feeding side of the paper received within the feeding cassette has been widely adopted.

As a separation unit having the inclined surface separation structure in the related art, a separation unit using a separation inclined surface provided in a fixed state has been widely used. Meanwhile, the separation inclined surface disclosed in JP-A-2007-153530 is configured such that the angle of the separation inclined surface is changed by the stiffness of the paper. The angle of the separation inclined surface is increased to increase a separating load resistance when the stiffness of the paper is strong, and the angle thereof is reduced to reduce the separating load resistance when the stiffness of the paper is weak, thereby preventing double feeding of the paper due to the stiffness of the paper.

However, there is a case in which the double feeding of the paper cannot be prevented simply by changing the angle of the separation inclined surface so as to correspond to only the degree of stiffness of the paper. That is, even in the case of papers having the same material and thickness, there is shown a characteristic that paper having a smaller paper width is easily bent, and paper having a larger paper width is not easily bent (detailed description thereof will be made later).

Thus, the separation inclined surface can separate the uppermost paper from the following paper when using, for example, A3 size paper. However, when using A6 size paper, a tip of the paper is upwardly dent to cross over the separation inclined surface, so that the separation inclined surface cannot separate the uppermost paper from the following paper.

In this case, when the same technical concept described in JP-A-2007-153530 is applied to the separation of the A6 size paper, the angle of the separation inclined surface is changed in a direction in which the separating load resistance is reduced, so that the double feeding of the paper may occur.

SUMMARY

An advantage of some aspects of the present invention is to provide a feeding device including a separation unit having an inclined surface separation structure, which may prevent double feeding of a material to be fed due to a difference in the bending of the material to be fed occurring in correspondence with differences in the width size of the material to be fed, thereby improving a separation performance when feeding the material to be fed.

According to an aspect of the invention, there is provided a feeding device for feeding a feed material, including: a receiving unit that receives stacked feed materials; a feeding guide unit that slides in accordance with the width size of the feed material received in the receiving unit, and comes into contact with a side of the feed material to guide the feed material; and a separation unit having an inclined surface structure that abuts on a tip of the fed feed material so that a separating load is exerted, and separates the following feed material to feed only the feed material at the uppermost position. Here, the separating load of the separation unit may be changed to at least two stages in conjunction with the movement in the width direction of the feeding guide unit.

In this aspect of the invention, since a separating load resistance is changed to at least two stages to correspond to a difference in the width size of the feed material, double feeding of the material to be fed occurring due to the difference in the width size of the feed material may be prevented.

In addition, by the switching-over of the separating load in the separation unit being in conjunction with the movement in the width direction of the feeding guide unit, the switching-over of the separating load state may be automatically performed while performing a series of operations when setting the feed material in the receiving unit. Thus, by reducing the burden on the user without forcing the user to perform the switching operation of the separating load of the separation unit which is required in accordance with the difference in the width size of the feeding material, it is possible to prevent a feeding failure such as double feeding of the feed material resulting from forgetting the switching-over.

In the feeding device according to another aspect of the invention, the separation unit may increase the separating load when using the feed material estimated for use and having a small width size, and reduce the separating load when using the feed material having a large width size.

In this aspect of the invention, when using the feeding material, having the small width size, that tends to be easily bent, it is possible to prevent the feed material from being bent and crossing over the separation unit by increasing the separating load resistance. Meanwhile, when using the feeding material having the large width size, and is not easily bent, it is possible to prevent an excessive separating load resistance from being exerted on the feed material by reducing the separating load resistance, thereby smoothly feeding the feed material having the large width size.

In the feeding device according to another aspect of the invention, the changing of the separating load may be performed by changing the number of the separation units abutting on the tip of the feed material.

In this aspect of the invention, when it is desired to increase the separating load resistance in accordance with the width size of the feeding material, an action area may be increased by increasing the number of the separation units abutting on an end face of a feeding side of the feeding material, thereby obtaining a desired separating load state in which the double feeding does not occur. Meanwhile, when it is desired to reduce the separating load resistance, the action area may be reduced by reducing the number of the separation units abutting on the end face of the feeding side of the feeding material, thereby preventing an excessive separating load resistance from being exerted.

In the feeding device according to another aspect of the invention, the changing of the separating load may be performed by changing the angle of a separating action surface of the separation unit abutting on the tip of the feed material.

In this aspect of the invention, when it is desired to increase the separating load resistance in accordance with the width size of the feeding material, an inclination may be made steep by increasing the angle of the separating action surface of the separation unit abutting on the end face of the feeding side of the feeding material, thereby obtaining a desired separating load state in which the double feeding does not occur. Meanwhile, when it is desired to reduce the separating load resistance, the inclination may be made gentle by reducing the angle of the separating action surface of the separation unit abutting on the end face of the feeding side of the feeding material, thereby preventing an excessive separating load resistance from being exerted.

In the feeding device according to another aspect of the invention, the changing of the separating load may be performed by changing the material or the shape of the separating action surface of the separation unit abutting on the tip of the feeding material, to a material or a shape having a different friction coefficient.

In this aspect of the invention, when it is desired to increase the separating load resistance in accordance with the width size of the feeding material, the material or the shape of the separating action surface of the separation unit abutting on the end face of the feeding side of the feed material may be replaced with a material or a shape having a great friction coefficient, thereby obtaining a desired separating load state in which the double feeding does not occur. Meanwhile, when it is desired to reduce the separating load resistance, the material or the shape of the separating action surface of the separation unit abutting on the end face of the feeding side of the feed material may be replaced with a material or a shape having a small friction coefficient, thereby preventing an excessive separating load resistance from being exerted.

In the feeding device according to another aspect of the invention, the separation unit may have a switching unit to enable a change in a mode different from a change in the separating load to be performed in accordance with a difference in properties such as the type, the thickness, or the like of the feeding material.

For example, when feeding a thick feed material having a small width size such as a post card, the changing of the separating load according to each aspect of the invention cannot be accomplished appropriately in response thereto. That is, in response to differences in the properties such as the type, the thickness, and the like of the feeding material, there is a need to perform the change in the mode different from the change in the separating load. In this aspect of the invention, in this case, since the separation unit has the switching unit capable of performing the change in the mode different from the change in the separating load, it is possible to switch to a separation inclined surface suitable for the separation of a thick post card, when the feeding guide unit is moved to match with the post card having the small width size by operation of the switching unit.

According to another aspect of the invention, there is provided a recording device performing recording on a feeding material, having the feeding device described in the first aspect.

In this aspect of the invention, as the recording device, operational effects in the feeding device may be obtained.

BRIEF DESCRIPTION OF THE DRAWINGS

The invention will be described with reference to the accompanying drawings, wherein like numbers reference like elements.

FIG. 11 is a principle explanation view explaining a relationship between the bending of a feeding material to be fed in a state in which a tip of the material to be fed abuts on a separating action surface of a separation unit and a separating load resistance.

DESCRIPTION OF EXEMPLARY EMBODIMENTS

Figure 1:
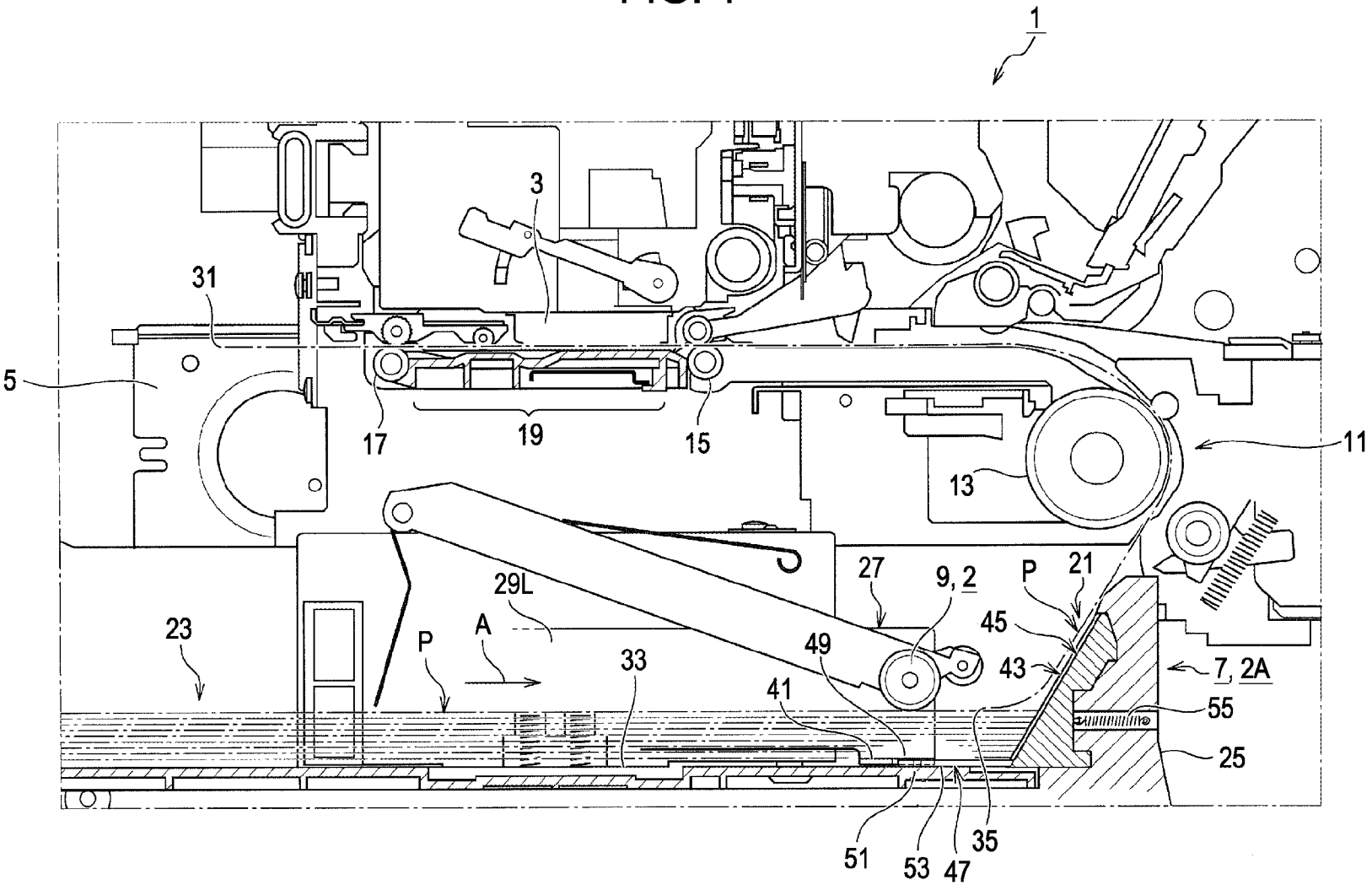
FIG. 1 is a side cross-sectional view showing a state in which a feeding device according to a first embodiment of the present invention is applied to a feeding cassette of an inkjet printer.

Hereinafter, a feeding device according to an embodiment of the invention will be described in detail with reference to the accompanying drawings.

A feeding device 2 including a feeding cassette 7 as an example applicable to an inkjet printer 1 which is an example of a recording device, a feeding roller 9, that is a feeding performance member installed in a printer main body 5 of the inkjet printer 1, and a driving device for driving the feeding roller 9 will be described herein, in addition to the feeding cassette 7.

In addition, the concept of the feeding device 2 according to the present embodiment may be further widened to include the meaning of the feeding device 2 including only the feeding cassette 7 without including the feeding roller 9, as well as the feeding device 2 including the feeding cassette 7 and the feeding roller 9.

First, the inkjet printer 1 that is an example of an application target of the feeding device 2 according to the present invention will be described in detail with reference to FIG. 1.

The inkjet printer 1 includes the feeding cassette 7 as a receiving unit capable of receiving a large number of materials P to be fed (hereinafter, referred to as "paper") in a lower portion of the printer main body 5 in a horizontally stacked state. The paper sheet P received in the feeding cassette 7 is repeatedly discharged toward a paper transport path 11 sheet by sheet in sequence from the uppermost paper sheet P by a feeding operation of the feeding roller 9, that is, the feeding performance member.

The paper transport path 11 of the inkjet printer 1 extends obliquely backward facing upward, and then is laid out to change its direction obliquely forward, and thereby further horizontally extends forward.

In the paper transport path 11, three rollers of a transport guide roller 13, a transport roller 15, and a discharge roller 17 which apply a transport force to the paper sheet P are provided in the stated order. In addition, a recording performance area 19 is provided between the forward transport roller 15 and the discharge roller 17, and a recording head 3 for ejecting ink having each color toward a face to be recorded of the paper sheet P is disposed in the recording performance area 19.

Figure 2:
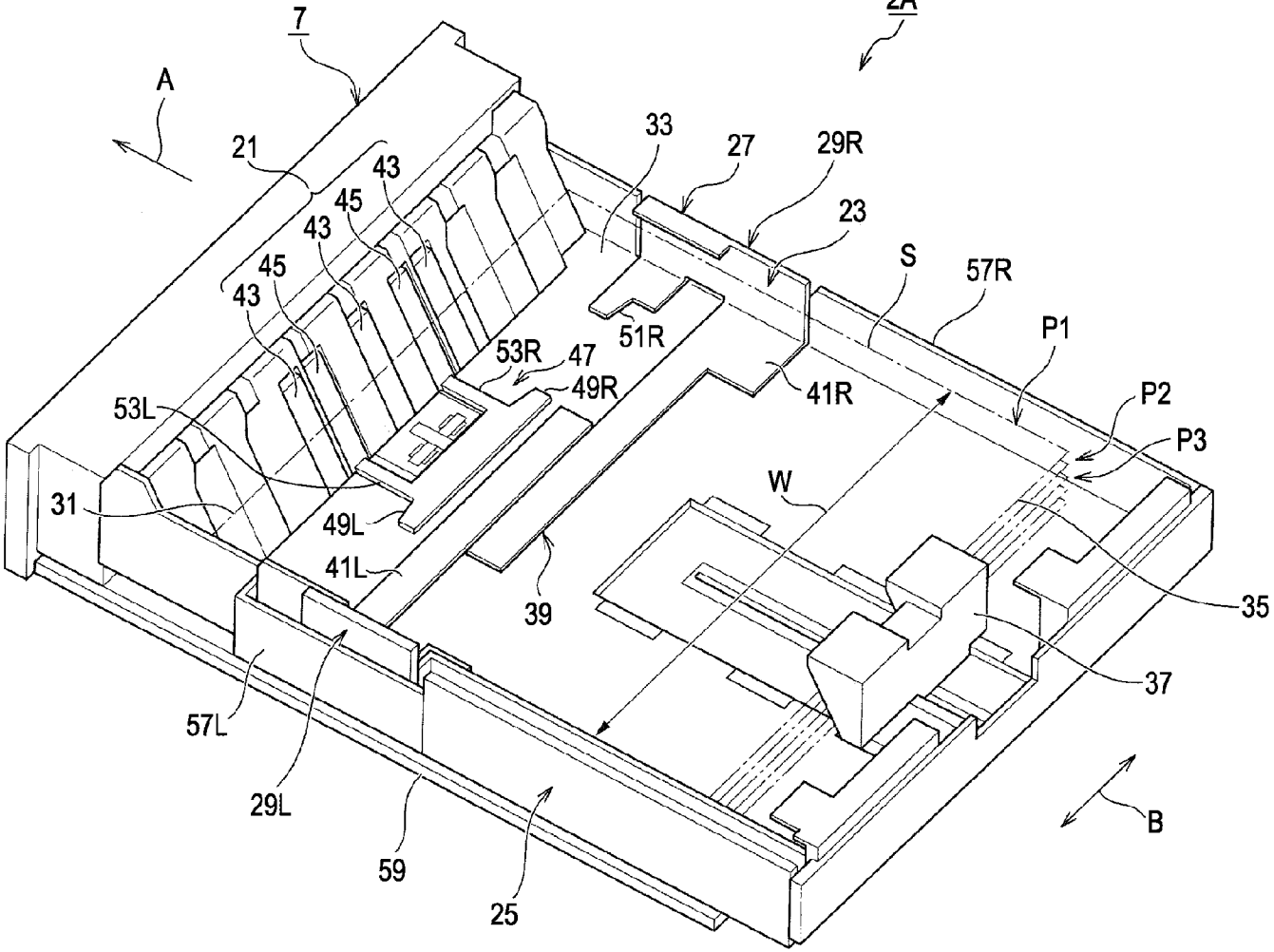
FIG. 2 is a perspective view obtained when setting a material to be fed having a large width size showing a feeding device according to a first embodiment of the invention.

As shown in FIG. 2, the feeding device 2 according to the present invention is basically configured to include a receiving unit 23 that receives a large number of stacked paper sheets P, that is, a constituent member of the above described feeding cassette 7, a feeding guide unit 27 that slides in accordance with a width size W of the paper sheet P received in the receiving unit 23 and comes into contact with a side S (hereinafter, referred to as "edge") of the paper sheet P to guide feeding of the paper P, and a separation unit 21 having an inclined surface separation structure that abuts on a tip 31 of the fed paper sheet P in a feeding direction A to feed only the uppermost paper sheet P1, thereby granting a separating load resistance Fc (see, FIG. 11) in which the uppermost paper P1 is separated from the following paper sheets P2, P3 . . . .

In addition, the separation unit 21 as a characteristic configuration of the feeding device 2 according to the invention is configured to change the separating load resistance Fc to at least two stages in correspondence to a difference in the width size W of the fed paper P, and configured to switch the separating load state of the separation unit 21 in conjunction with the movement of the feeding guide unit 27 in the width direction B.

First Embodiment

In FIGS. 1 to 7, a feeding device 2A according to a first embodiment is illustrated. The feeding device 2A according to the first embodiment includes a cassette main body 25, that is a rectangular container shaped member with a flat receiving unit 23. An upper surface of the cassette main body 25 is opened, and exchange and replenishing of the paper sheets P from the opened upper surface of the cassette main body 25 is carried out.

In an upper surface side of a bottom plate 33 of the cassette main body 25, edge guides 29L and 29R as an example of the above described feeding guide unit 27, and a positioning guide 37 of a sliding type that abuts on a rear end 35 of the paper sheet P received in the cassette main body 25 to thereby position the front and rear direction of the paper sheet P are provided.

Of these, the edge guides 29L and 29R are edge guides of a centering type, as an example in which the edge guides are arranged in left and right as a pair. The left and right edge guides 29L and 29R facing each other are operated in conjunction with each other by an approaching/separating mechanism 39 configured by, for example, a rack and pinion mechanism.

In bottom plates 41L and 41R of the left and right edge guides 29L and 29R, abutting action units 51L and 51R having an inclined abutting surface abutting on left and right abutting units 49L and 49R of a working body 47 for working a movable separation unit 45, which will be described later, are provided.

In addition, the working body 47 includes the abutting units 49L and 49R formed in the side of the edge guides 29L and 29R, and is a member formed into a gate shape in a plan view, which includes connection arms 53L and 53R connected to a part of the movable separation unit 45 in the side of the movable separation unit 45 which will be described later. In addition, since the biasing force of an biasing member 55 such as a constant tension coil spring, and the like acts on the working body 47, the abutting action units 51L and 51R abut on the abutting units 49L and 49R, and thereby the working body 47 is moved to the side of the edge guide 29 against the biasing force of the biasing member 55.

As an example of left and right side plates 57L and 57R of the cassette main body 25, in the bottom of the outer surface, a guide rib 59 as a guide when mounting to or removing from the printer main body 5 is provided.

In an end of the inner part side of the cassette main body 25, the separation unit 21 is provided including three fixed separation units 43 provided to be spaced by an appropriate distance in a center of a width direction B of the cassette main body 25 and two movable separation units 45 positioned between the fixed separation units 43.

In addition, in a front surface of each of the fixed separation unit 43 and the movable separation unit 45, separating action surfaces 43*a* and 45*a* (see, FIG. 3) having a predetermined angle θ configured by a front-downward inclined surface are formed.

Figure 3:
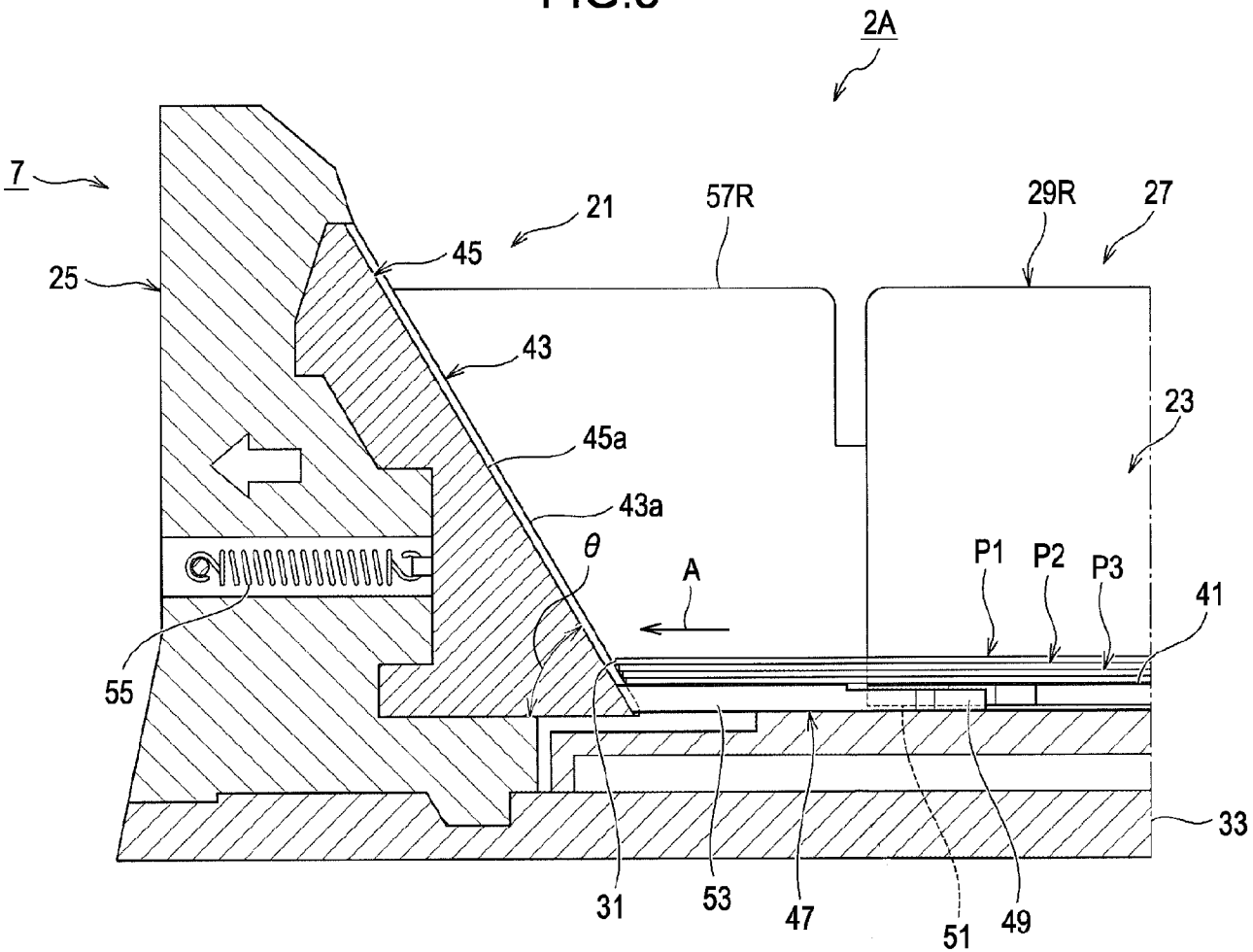
FIG. 3 is a side cross-sectional view obtained when setting a material to be fed having a large width size shown by enlarging a vicinity of a separation unit of a feeding device according to a first embodiment of the invention.
Figure 4:
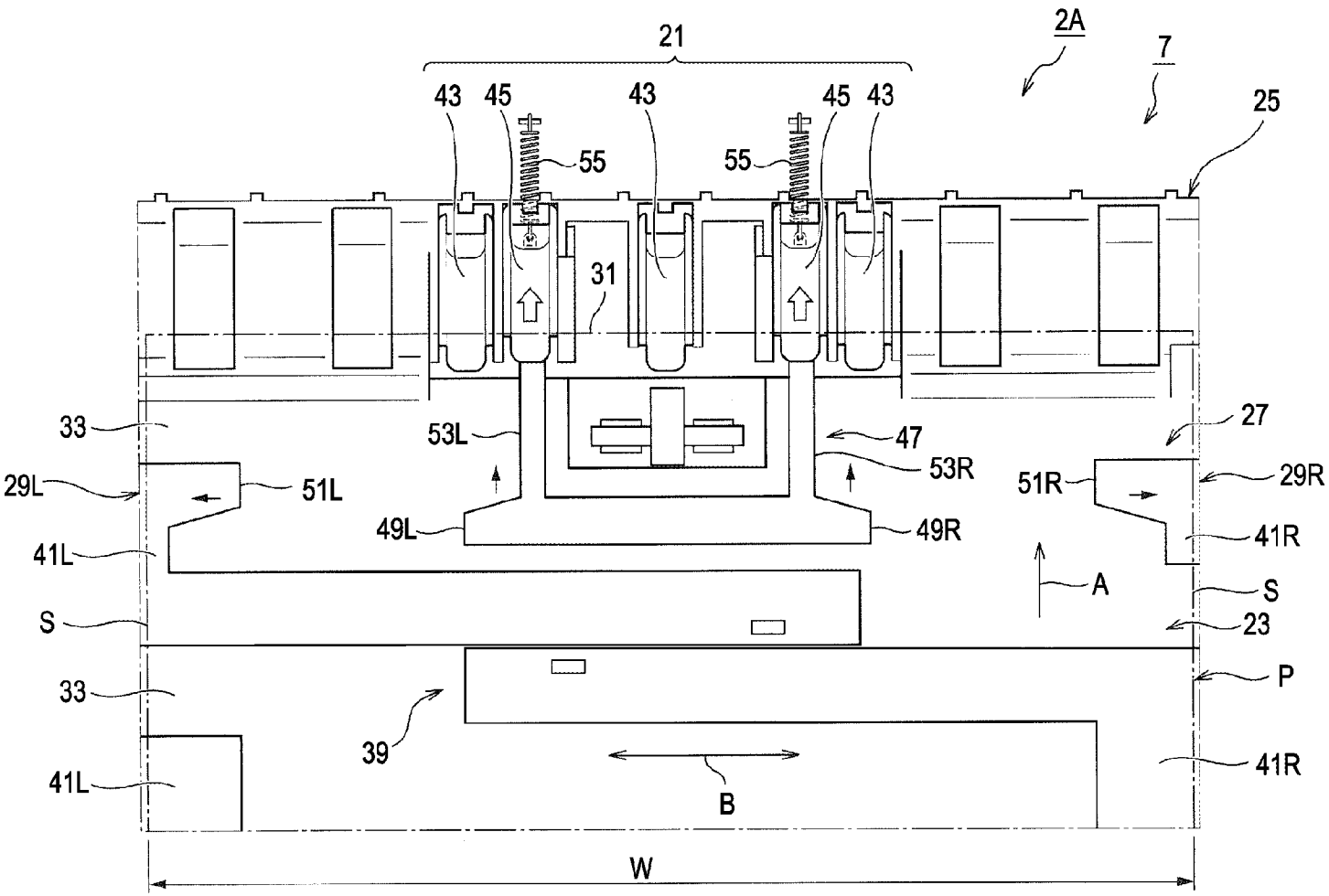
FIG. 4 is a plan view obtained when setting a material to be fed having a large width size shown by enlarging a vicinity of a separation unit of a feeding device according to a first embodiment of the invention.
Figure 5:
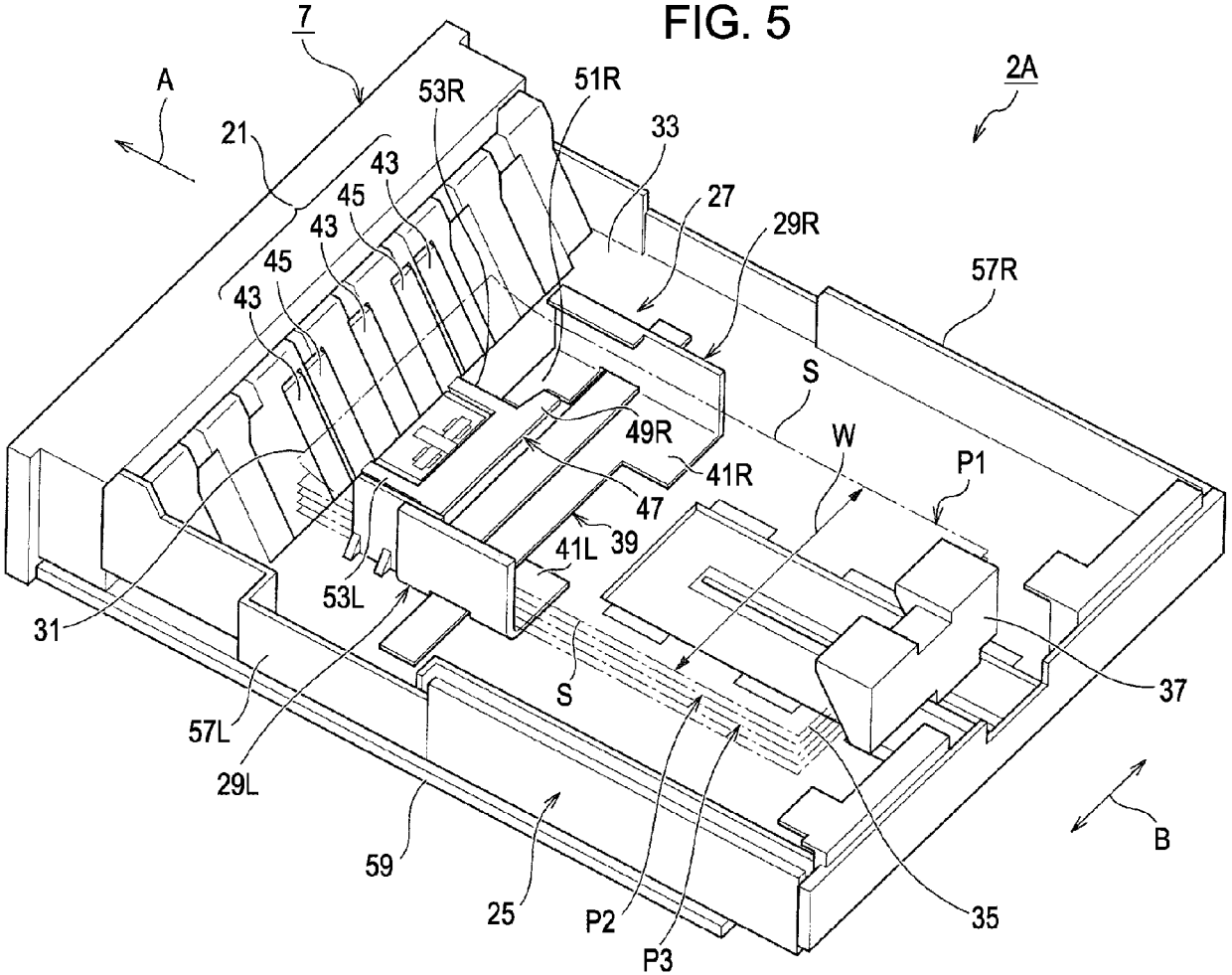
FIG. 5 is a perspective view obtained when setting a material to be fed having a small width size showing a feeding device according to a first embodiment of the invention.

In addition, as shown in FIG. 3, in a state in which the abutting action units 51L and 51R do not abut on the abutting units 49L and 49R, the separating action surface 45*a* of the movable separation unit 45 is slightly further rearward than the separation action surface 43*a* of the fixed separation unit 43, and thereby the separating action surface 45*a* does not abut on an end face 31 of the feeding side of the paper P.

Figure 6:
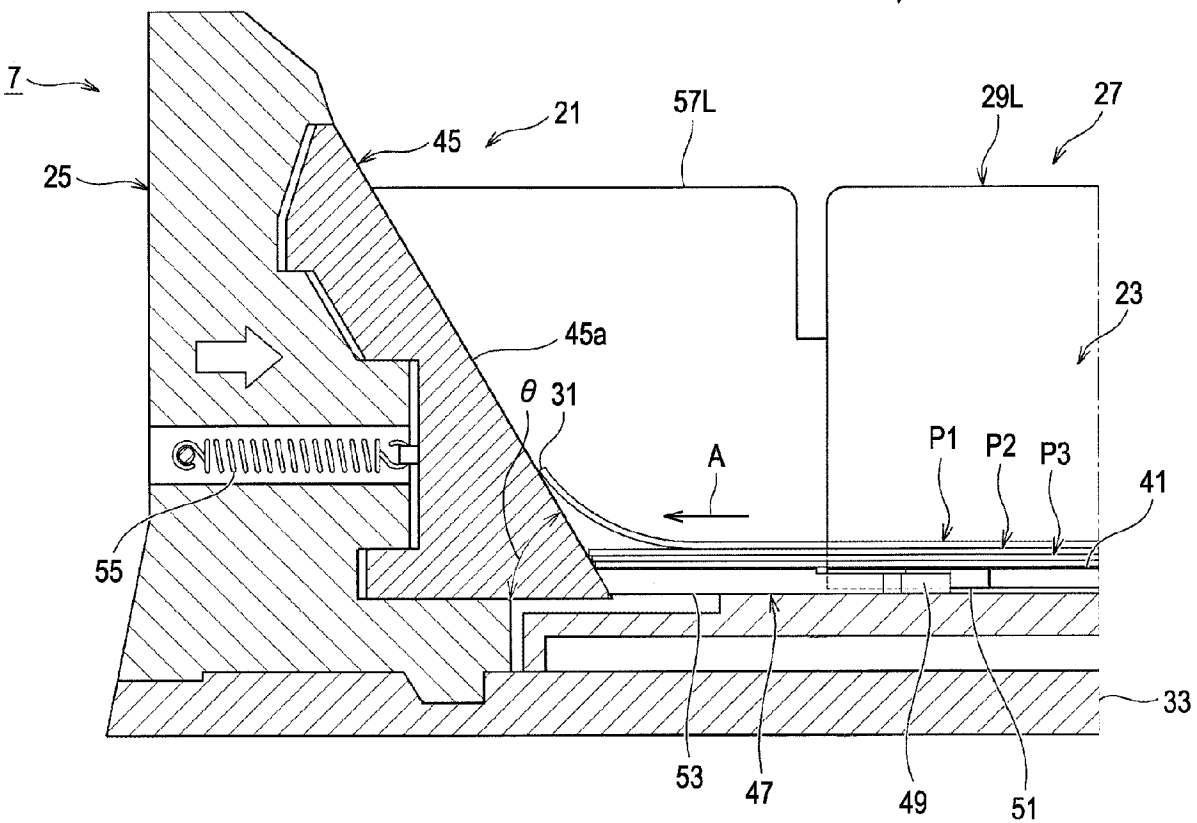
FIG. 6 is a side cross-sectional view obtained when setting a material to be fed having a small width size shown by enlarging a vicinity of a separation unit of a feeding device according to a first embodiment of the invention.
Figure 7:
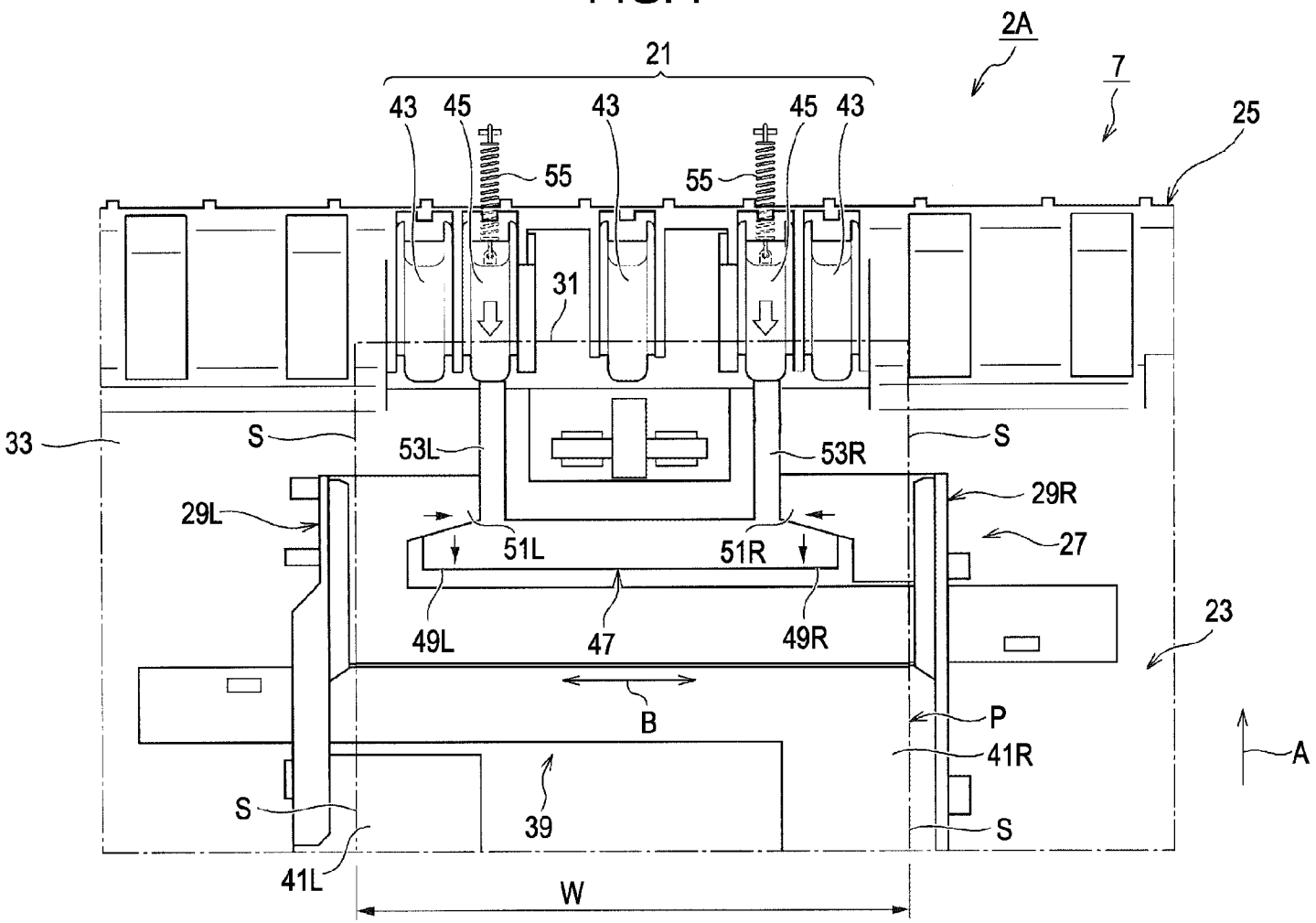
FIG. 7 is a plan view obtained when setting a material to be fed having a small width size shown by enlarging a vicinity of a separation unit of a feeding device according to a first embodiment of the invention.

Meanwhile, as shown in FIG. 6, in a state in which the abutting action units 51L and 51R abut on the abutting units 49L and 49R, the movable separation unit 45 is slightly pulled forward, so that the separating action surface 45*a* is configured to be flush with the separating action surface 43*a* of the fixed separation unit 43.

By adopting the above described configuration, when using the paper sheet P having a small width size W such as an A6 vertical size sheet, the number of separation units 21 abutting on the tip 31 of the paper sheet P in a feeding direction is increased up to a total of five including the movable separation unit 45 in the fixed separation unit 43, thereby increasing the separating load resistance Fc.

Meanwhile, when using the paper sheet P having a large width size W such as A4 size or an A3 size, since only the fixed separation unit 43 abuts on the tip 31 of the paper P, the number of the separation units 21 is reduced down to a total of three, thereby reducing the separating load resistance Fc.

Here, based on the principal explanation view of FIG. 11, a relationship between bending δ of the paper sheet P and the separating load resistance Fc in a state in which the tip 31 of the paper sheet P abuts on the separating action surfaces 43*a* and 45*a* of the separation unit 21 will be described in detail.

In addition, in FIG. 11, δmax denotes a maximum bending crossing over the separating action surfaces 43*a* and 45*a* when assuming that the paper sheet P is a beam, μs denotes a friction coefficient between the paper sheet P and the separating action surfaces 43*a* and 45*a*, θ denotes an inclination angle of each of the separating action surfaces 43*a* and 45*a*, Fn denotes a maximum reactive force crossing over the separating action surfaces 43*a* and 45*a* when assuming that the paper sheet P is the beam, Fc denotes a separating load resistance from the separation unit 21, which is exerted on the tip 31 of the paper sheet P, L denotes a distance from a nip point of the feeding roller 9 to the tip 31 of the paper sheet P, μr denotes a friction coefficient between the paper sheet P and the feeding roller 9, E denotes a vertical elastic coefficient, I denotes a section modulus of the paper sheet P having a width b and a thickness h.

In this case, since the maximum bending δmax is represented as $\delta max = Fn \cdot L^3/3EI$, the maximum reactive force Fn is $Fn = 3EI \cdot \delta max/L^3$. In addition, since the separating load resistance Fc is $Fc = Fn \cdot (\mu s + \tan\theta)/(1 - \mu s + \tan\theta)$, $Fc = (3EI \cdot \delta max/L^3) \cdot (\mu s + \tan\theta)/(1 - \mu s + \tan\theta)$ is obtained when substituting Fn using this formula. Here, since the section modulus I is represented as $I = bn^3/12$, the separating load resistance Fc is increased along with an increase in the width b of the paper sheet P when the thickness h of the paper sheet P is constant.

Similarly, since the maximum bending δmax is reduced along with the increase in the width b of the paper sheet P, the paper sheet P is not easily bent due to increased rigidity. Conversely, since the separating load resistance Fc is reduced along with a reduction in the width b of the paper sheet P, the paper sheet P easily crosses over the separating action surfaces 43*a* and 45*a*.

In addition, similarly, since the maximum bending δmax is increased along with the reduction in the width b of the paper sheet P, the paper sheet P is easily bent due to the reduced rigidity.

In addition, according to the present embodiment, using a width adjustment by the edge guides 29L and 29R performed when setting, in the cassette main body 25 which is the receiving unit 23, the paper sheet P having the small width size W that easily crosses over the separating action surfaces 43*a* and 45*a* due to the increased bending δ, the number of the separation units 21 is automatically increased, thereby increasing the separating load resistance Fc.

Thus, it is possible to prevent double feeding due to the bending δ of the paper sheet P having the small width size W, thereby realizing the smooth feeding of the feeding device 2.

Meanwhile, with respect to the paper sheet P having the large width size W, the movable separation unit 45 is further retreated as described above, and only the fixed separation unit 43 abuts on the tip 31 of the paper sheet P, so that it is possible to prevent the excessive separating load resistance Fc, thereby contributing to the smooth feeding of the feeding device 2.

Second Embodiment

Figure 8:
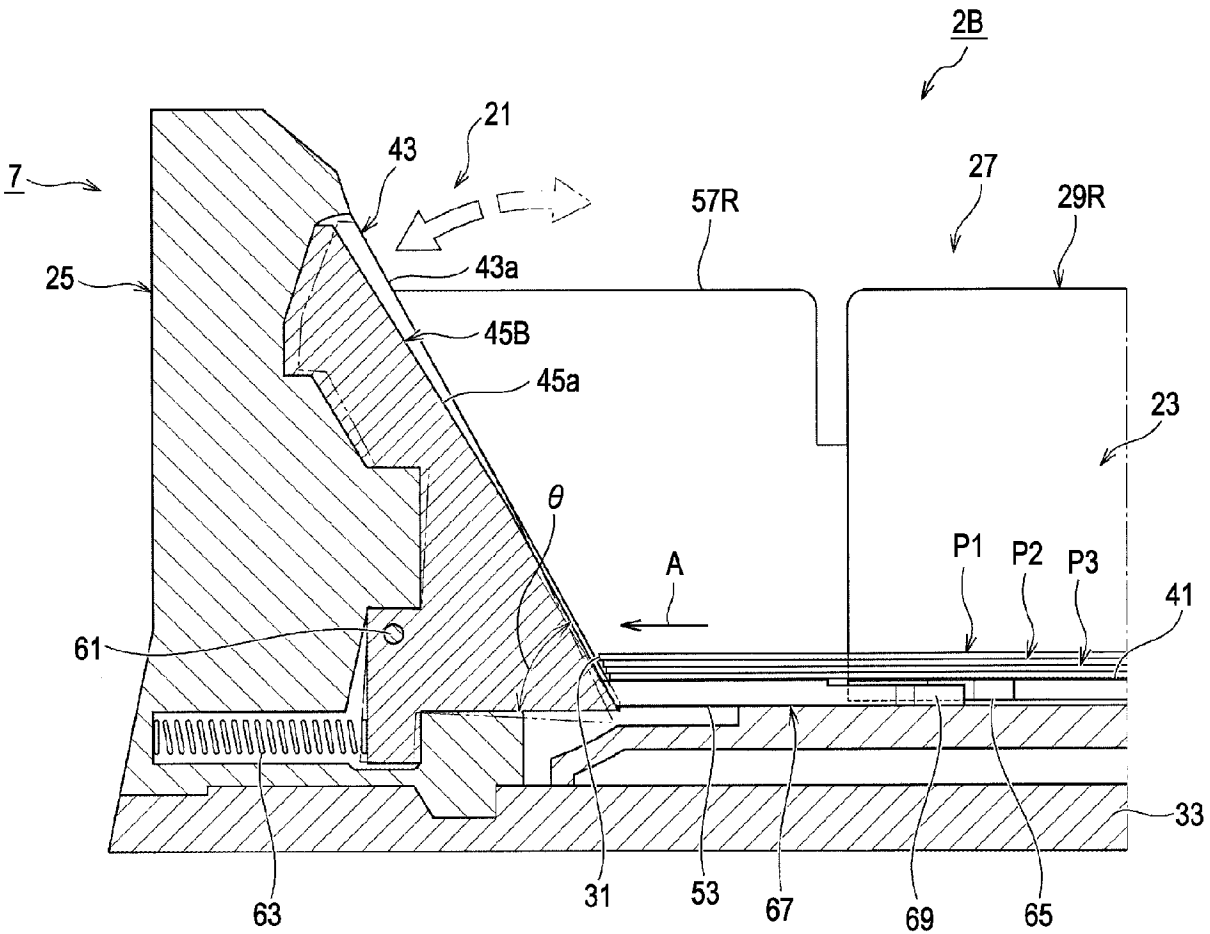
FIG. 8 is a side cross-sectional view obtained when setting a material to be fed having a small width size shown by enlarging a vicinity of a separation unit of a feeding device according to a second embodiment of the invention.
Figure 9:
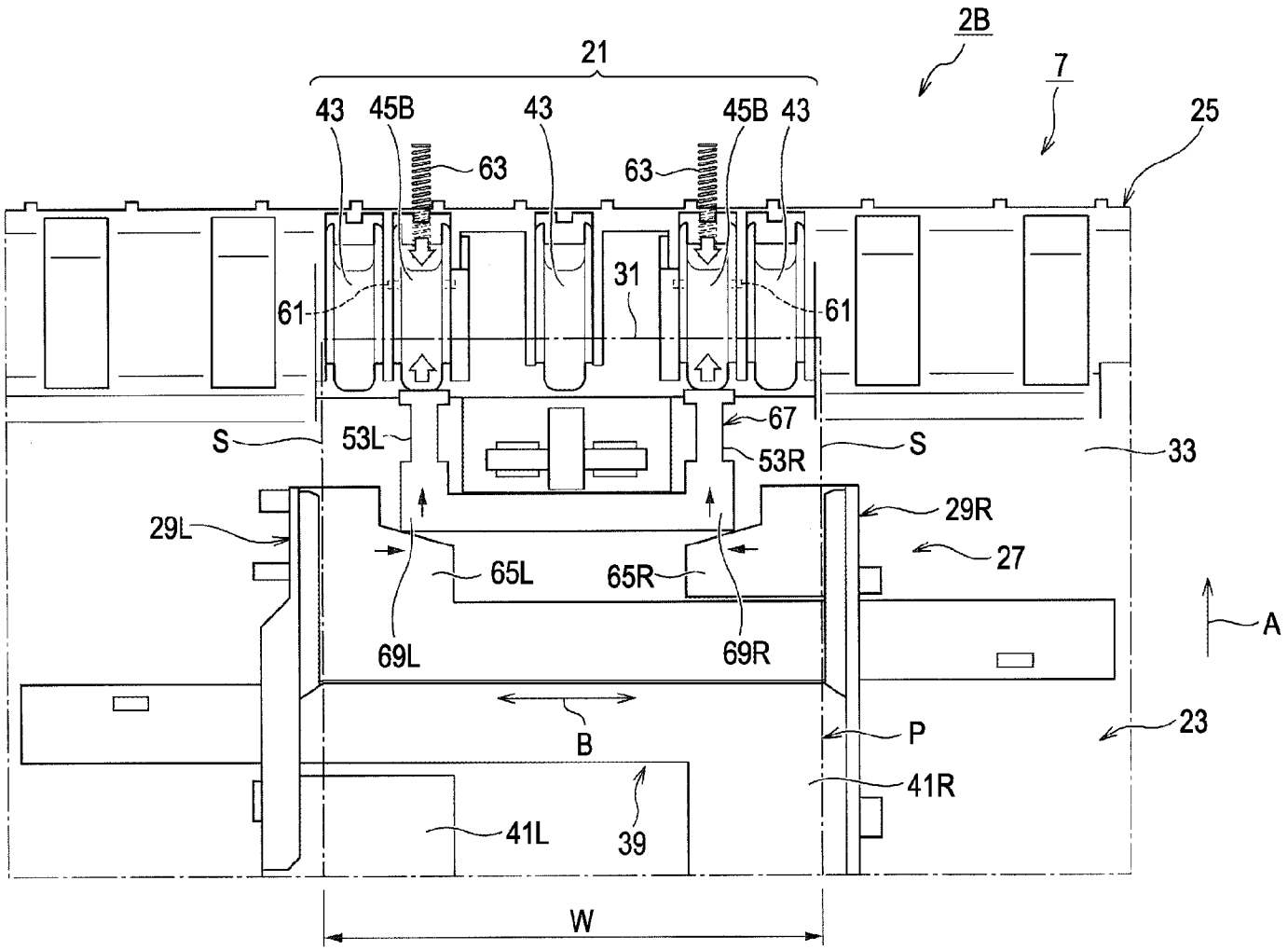
FIG. 9 is a plan view obtained when setting a material to be fed having a small width size shown by enlarging a vicinity of a separation unit of a feeding device according to a second embodiment of the invention.

In FIGS. 8 and 9, a feeding device 2B according to a second embodiment is shown. The feeding device 2B according to the second embodiment differs from the feeding device 2A according to the first embodiment with respect to the structure of operating the movable separating unit 45B, and an embodiment of changing the separating load resistance Fc, and is the same as the feeding device 2A in the first embodiment with respect to the other structures.

Thus, hereinafter, the structure of operating the movable separation unit 45B, that is a unique structure of the feeding device 2B according to the second embodiment and the embodiment of changing the separating load resistance Fc will be described in detail.

First, according to the present embodiment, the embodiment of changing the separating load resistance Fc is performed by changing an angle θ of the separating action surface 45*a* of the separation unit 21 abutting on the tip 31 of the paper sheet P. That is, according to the present embodiment, as shown in FIG. 8, the movable separation unit 45B is configured to be rotated by a predetermined angle around a rotational pivot point 61, so that the separating action surface 45*a* of the movable separation unit 45B is always biased in a direction where the inclination angle θ becomes smaller, by a biasing zing member 63 including a compression coil spring as an example.

Next, the structure of operating the movable separation unit 45B uses the edge guides 29L and 29R as a driving source in the same manner as that in the first embodiment. In addition, abutting action surfaces 65L and 65R including an inclination guide surface formed in the side of the movable separation unit 45B abut on abutting units 69L and 69R of a working body 67 in a predetermined distance by bringing the edge guides 29L and 29R close to each other as shown in FIG. 9, so that the movable separation unit 45 is rotated against the biasing force of the biasing member 63 by pushing the abutting units 69L and 69R to the inner part side, thereby increasing the inclination angle θ of the separating action surface 45*a*.

Accordingly, even in the present embodiment, when using the paper sheet P having the small width size W, the movable separation unit 45B is rotated in a near side in conjunction with a movement in a direction where the edge guides 29L and 29R are brought close to each other, so that the inclination angle θ is increased, and the inclination is made steep. Due to this, the separating load resistance Fc is increased, thereby preventing the double feeding of the paper sheet P due to the bending δ of the paper sheet P having the small width size W in which the bending δ easily occurs.

In addition, when using the paper sheet P having the large width size W, since the abutting action units 65L and 65R are isolated from the abutting units 69L and 69R, the movable separation unit 45B is rotated in the inner part side by the biasing force of the biasing member 63, so that the inclination angle θ is reduced, and the inclination is made gentle. As a result, the separating load resistance Fc is reduced, thereby preventing a feeding failure of the paper sheet P occurring when the excessive separating load resistance Fc is exerted.

Third Embodiment

Figure 10:
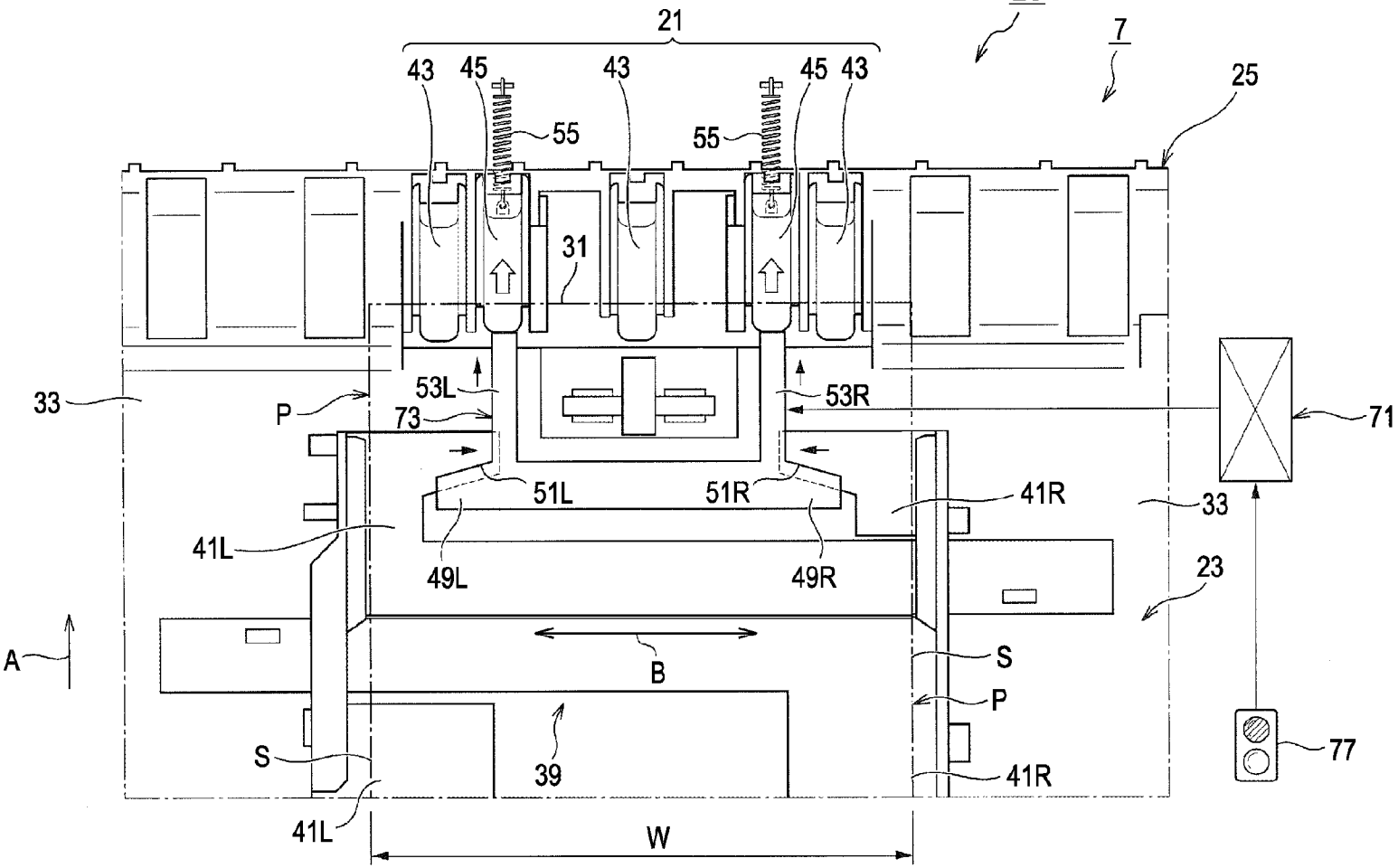
FIG. 10 is a plan view obtained when moving, toward the non-abutting position, a separation unit shown by enlarging a vicinity of a separation unit of a feeding device according to a third embodiment of the invention.

In FIG. 10, a feeding device 2C according to a third embodiment is shown. The feeding device 2C according to the third embodiment includes a switching unit 71 to enable a change in a mode different from a change in the separating load to be performed in accordance with a difference in properties such as the type, the thickness, or the like of the paper sheet P according to the first and second embodiments.

That is, the embodiment has the same configuration of the movable separation unit 45 as that described in the first and second embodiments; however, differs from the first and second embodiments with respect to including the switching unit 71 of switching an operation state and a non-operation state of the movable separation unit 45 in accordance with the properties of the paper sheet P.

That is, the difference in the properties and the state such as the type, the thickness, or the like of the paper sheet P is identified by a switching operation of a user performed by setting information according to a user's input, a switching button 77, or the like, and whether changing of the separating load resistance Fc by the movable separation unit 45 is performed is determined.

When the separating load resistance Fc is determined not to be performed, a state in which the abutting action units 51L and 51R do not abut on the abutting units 49L and 49R even though the abutting action units 51L and 51R are brought close to the abutting units 49L and 49R is obtained, by moving the working body 73 upwardly or downwardly as shown in FIG. 10. In this state, since the separating load resistance Fc is the same as that obtained when using the paper sheet P having the large width size W, which has a small bending δ, when using the paper sheet P having the small bending δ such as a post card, a smooth feeding of the paper sheet P is realized without exerting an excessive separating load resistance Fc on the paper sheet P.

In addition, when operating the switching unit 71, it is possible to limit the amount of movement of the movable separation unit 45 without stopping the movement of the movable separation unit 45. Accordingly, the degree of the separating load resistance Fc is adjusted to cope with the various properties of the paper sheet P.

Another Embodiment

The feeding device 2 according to the invention has the above described configuration; however, modification, omission, or the like of the configuration may be partially performed in a scope without departing from the principles and spirit of the disclosure.

For example, as another embodiment changing the separating load resistance Fc by the separation unit 21, the material or the shape of the separating action surfaces 43*a* and 45*a* of the separation unit 21 abutting on the tip 31 of the paper sheet P may be changed to a material or a shape having a different friction coefficient μs. For example, as a change of the material, a change between a rubber material having a large friction coefficient μs and a plastic material having a small friction coefficient μs may be given, and as a change of the shape, a change between an uneven surface having a large friction coefficient μs and an even surface having a small friction coefficient μs may be given.

In addition, the embodiment of changing the various separating load resistance Fc is not limited to two stages, and may be performed in at least three stages or more, or may be continuously performed. In addition, the positioning of the edge guide 29 may adopt a centering method as described in the above embodiment, and may also adopt a one-sided positioning method performed based on a side S (edge) of either side of the left or the right sides of the paper sheet P.

In addition, all of the separation units 21 may be configured only by the movable separation unit 45.

In addition, the feeding target of the feeding device 2 in the invention is not limited to the paper sheet P, and may be a synthetic resin film such as a polyester film, and the like. In addition, the feeding device 2 in the invention is not limited to being removed from a device main body such as in the feeding cassette 7, and may be applied to an automatic paper feeding device of a feeding tray type to be integrally assembled with respect to the printer main body 5 of the inkjet printer 1. Furthermore, the feeding device of the invention may be applied to other recording devices such as copiers, facsimiles, and the like, or may be applied to various devices dealing with sheet-shaped goods other than the recording device.

What is claimed is:

1. A feeding device for feeding a feeding material, comprising:

a receiving unit that receives stacked feeding materials;

a feeding guide unit that slides in accordance with a width size of the feed material received in the receiving unit, and comes into contact with a side of the feed material to guide the feed material; and a separation unit having an inclined surface structure that abuts on a tip of the fed feed material so that a separating load is exerted, and separates the following feed material to feed only the feed material at the uppermost position, wherein the separating load of the separation unit is changed to at least two stages in conjunction with a movement in a width direction of the feeding guide unit, the movement being based on a width of the feeding material such that the separation load is increased for feeding material having a small width and decreased for feeding material having a large width, wherein the change of the separating load is performed by changing a material of a separating action surface of the separation unit abutting on the tip of the feeding material with a first friction coefficient to a material having a second friction coefficient or changing a shape of the separating action surface of the separation unit abutting on the tip of the feeding material with a first friction coefficient to a shape having a different friction coefficient.

2. The feeding device of claim 1, wherein the separation unit increases the separating load when using the feed material estimated for use and having a small width size, and reduces the separating load when using the feed material having a large width size.

3. The feeding device of claim 1, wherein the change of the separating load is performed by changing a number of the separation units abutting on the tip of the feeding material.

4. The feeding device of claim 3, wherein the separation unit has a fixed separation unit and a movable separation unit, and changes the number of the separation units by moving the movable separation unit by the movement in the width direction of the feeding guide unit.

5. The feeding device of claim 1, wherein the change of the separating load is performed by changing an angle of a separating action surface of the separation unit abutting on the tip of the feeding material.

6. The feeding device of claim 1, wherein the separation unit has a switching unit to enable a change in a mode different from a change in the separating load to be performed in accordance with a difference in properties such as a type, a thickness, or the like of the feeding material.

7. A recording device performing recording on a feeding material, having a feeding device described in claim 1.

8. A feeding device for feeding a feeding material, comprising:

a receiving unit that receives stacked feeding materials;

a feeding guide unit that slides in accordance with a width size of the feed material received in the receiving unit, and comes into contact with a side of the feed material to guide the feed material; and a separation unit having an inclined surface structure that abuts on a tip of the fed feed material so that a separating load is exerted, and separates the following feed material to feed only the feed material at the uppermost position, wherein the separating load of the separation unit is changed to at least two stages in conjunction with a movement in a width direction of the feeding guide unit, the movement being based on a width of the feeding material such that the separation load is increased for feeding material having a small width and decreased for feeding material having a large width, wherein the change of the separating load is performed by changing a number of the separation units abutting on the tip of the feeding material, and wherein the separation unit has a fixed separation unit and a movable separation unit, and changes the number of the separation units by moving the movable separation unit by the movement in the width direction of the feeding guide unit.

* * * * *